United States Patent [19]

Ackert et al.

[11] Patent Number: 4,895,605

[45] Date of Patent: Jan. 23, 1990

[54] METHOD FOR THE MANUFACTURE OF HARDENED RAILROAD RAILS

[75] Inventors: Robert J. Ackert; Murray A. Nott, both of Sault Ste. Marie, Canada

[73] Assignee: Algoma Steel Corporation, Sault Ste. Marie, Canada

[21] Appl. No.: 234,400

[22] Filed: Aug. 19, 1988

[51] Int. Cl.[4] ..... C21D 9/04

[52] U.S. Cl. ..... 148/12.1; 148/12.4; 148/12 B; 148/146

[58] Field of Search ..... 148/146, 14 S, 12 F, 148/12.4, 12.1, 12 B, 334, 333, 320

[56] References Cited

U.S. PATENT DOCUMENTS

| | | | |
|---|---|---|---|
| 4,375,995 | 3/1983 | Sugino et al. | 148/12 R |
| 4,426,236 | 1/1984 | Sugino et al. | 148/12.4 |
| 4,486,248 | 12/1984 | Ackert et al. | 148/149 |
| 4,668,308 | 5/1987 | Economopoulos et al. | 148/12 R |
| 4,714,500 | 12/1987 | Heller et al. | 148/134 |

FOREIGN PATENT DOCUMENTS

| | | |
|---|---|---|
| 1024422 | 11/1978 | Canada . |
| 1058492 | 7/1979 | Canada . |
| 59-124592 | 9/1986 | Japan . |

OTHER PUBLICATIONS

Effects of Manganese, Chromium, and Molybdenum on the Isothermal Transformation of Austenite in Eutectoid Steels by Y. S. Park and F. B. Fletcher, 1986 American Society for Metals, vol. 4, No. 3, Jun. 1986, pp. 247–252.

*Primary Examiner*—Deborah Yee

*Attorney, Agent, or Firm*—Merchant, Gould, Smith, Edell, Welter & Schmidt

[57] ABSTRACT

An improved method for the manufacture of hardened railroad rails comprises the steps of forming a railroad rail from an alloy steel of a preselected chemical composition, force cooling the rail from a preselected cooling start temperature above about the austenite-to-ferrite transformation temperature, terminating the force cooling when the temperature of rail reaches a preselected cooling stop temperature, and before a substantial volume fraction of the austenite in the rail head has transformed to pearlite, and holding the rail under substantially isothermal conditions until the austenite-to-pearlite transformation is complete. The chemical composition of the alloy steel is selected such that the austenite-to-pearlite reaction occurs earlier in time than the austenite-to-bainite reaction under the substantially isothermal conditions. The use of this method makes avoidance of bainite easier to achieve, so relatively simple and inexpensive process control equipment can be utilized.

22 Claims, 8 Drawing Sheets

METHOD FOR THE MANUFACTURE OF HARDENED RAILROAD RAILS

FIELD OF THE INVENTION

This invention relates to an improved method for the manufacturing of hardened railroad rails.

BACKGROUND OF THE INVENTION

Historically, railroad rails have been made from carbon steels, having a hardness of about 270 on the Brinell hardness number scale. However, over the years, as loads became heavier and traffic volumes higher, railway companies began to demand a harder rail, having better wear characteristics. Steel companies responded to this demand in the 1960's by producing a high alloy rail, having a steel composition which included about 1.4% chromium, and an average hardness of about 335 Brinell. Subsequently, other high alloy rails, having chemical compositions which included alloys such as molybdenum and vanadium in addition to chromium, were developed. These high alloy rails, however, proved to be expensive to produce and difficult to weld. Moreover, brittle martensite tends to be formed in the welds of these high alloy rails, which can cause the weld to break catastrophically.

More recently, a number of methods have been developed for the production of a premium rail composed of fine pearlite and having an average hardness of 370 Brinell. Off-line head hardening methods, involving re-heating rolled rail sections made from carbon steel, were introduced, but these methods are costly and suffer from low production rates. These disadvantages are overcome by in-line accelerated cooling processes for treating carbon rails, such as those described in U.S. Pat. No. 4,486,248 (Ackert et al) granted to the Algoma Steel Corporation, Limited, and U.S. Pat. No. 4,668,308 (Economopoulos et al), granted to Centre de Researches Metallurgiques and Metallurgique et Miniere du Rodange-Athus et al. The Algoma Steel process results in a relatively hard carbon steel rail, having an average head hardness of 360 Brinell, which is easier to weld, and less expensive to manufacture, than high alloy rails or off-line heat treated rails. However, hardened carbon rails, whether produced by an on-line or an off-line process, require the end user to perform special welding techniques, in order to avoid soft welds which wear prematurely. Not all railway companies have the inclination or expertise to employ special welding techniques on a consistent basis. As a result, there remains a need for an inexpensive premium rail having desirable welding properties.

SUMMARY OF THE INVENTION

The present inventors have found that a premium rail having a desirable degree of hardness and welding properties can be created economically and with a minimum of process control by subjecting a rail having a specified low alloy composition to an heat treatment process, wherein the rail is subjected to forced cooling which is terminated prior in time to the beginning of the austenite to pearlite transformation, and wherein the rail is then held under isothermal conditions until the austenite to pearlite transformation is complete. The method of the present invention, rather surprisingly, causes the pearlite reaction to be accelerated, and the bainite reaction to be retarded, during an isothermal phase transformation. Because of this time separation of the two reactions, use of the subject method makes avoidance of bainite easier to achieve. As a result, it is possible to control the heat treatment process by means of relatively simple and inexpensive process control equipment. The combination of an on-line process involving simple process control equipment and less costly low alloy steels results in a relatively inexpensive premium rail having the requisite degree of hardness and weldability.

In accordance with the present invention, there is provided a method for manufacturing a railroad rail, comprising the steps of forming a railroad rail from an alloy steel of preselected chemical composition; force cooling at least the head portion of the railroad rail from a cooling start temperature above about the austenite-to-ferrite transformation temperature, in such a manner that the surface of the rail is maintained at a temperature above the martensite start temperature for rail steel; terminating the forced cooling when the temperature of the rail reaches a preselected cooling stop temperature, and before a substantial volume fraction of the austenite in the rail head has transformed to pearlite; and holding the rail under substantially isothermal conditions until the austenite-to-pearlite transformation is complete; wherein the chemistry of the alloy steel is selected such that the austenite-to-pearlite transformation occurs earlier in time than the austenite-to-bainite transformation, during isothermic conditions.

Preferably, the alloy steel has a chemical composition which is within the limits by weight of about 0.70 to 0.82% carbon, about 0.70 to 1.10% manganese, 0.20 to 1.50% chromium, up to about 0.20% vanadium, up to about 0.05% columbium, up to about 0.03% titanium, and up to about 0.10% molybdenum, the balance being iron and incidental impurities. More preferably, the alloy steel comprises about 0.20 to 1.00% chromium, up to about 0.10% vanadium, and up to about 0.10% molybdenum. The preselected cooling stop temperature is preferably in the range from about 850°-1200° F., more preferably in the range from about 1000° to about 1200° F., and most preferably in the range from about 1000°-1100° F.

BRIEF DESCRIPTION OF THE DRAWINGS

The invention will now be described, by way of example only, with reference to the following drawings, in which.

DETAILED DESCRIPTION OF THE PREFERRED EMBODIMENTS

Figure 1:
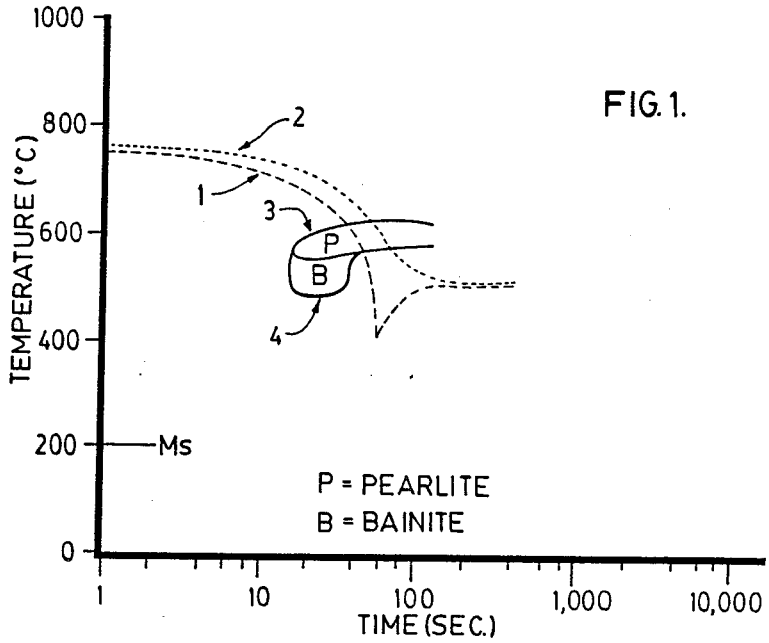
FIG. 1 shows various cooling curves plotted on a logarithmic time scale and which are superimposed on a continuous cooling transformation diagram determined for a standard AREA carbon steel rail with a chemical composition by weight of 0.75% carbon, 0.98% manganese and 0.30% Si, the balance being iron and incidental impurities.

FIG. 1 shows the time-temperature cooling curves 1, 2 measured at 1 mm and 20 mm below the running surface of a standard carbon rail section cooled by the method described in U.S. Pat. No. 4,486,248, superimposed on the continuous cooling transformation diagram determined for a standard carbon rail. In FIG. 1, P denotes the areas delineated by curve 3 in which the steel transforms from austenite to pearlite, and B denotes the areas delineated by curve 4 in which the steel transforms from austenite to bainite. Ms denotes the temperature at which the martensite reaction starts. An examination of FIG. 1 reveals that the cooling curve 1 for the 1 mm position passes very close to the bainite area of the continuous cooling transformation diagram (i.e, the area B bounded by curve 47. This means an accurate process control system is required in order to avoid the formation of bainite when standard carbon rail steel chemistry is used. Maximizing rail hardness by increasing the cooling rate on the rail surface can lead to the formation of a thin layer containing varying volume fractions of bainite. Rails containing some volume fraction of bainite in the running surface are acceptable for some applications. However, in severe service, it has been demonstrated that the rate of surface deterioration increases with increasing volume fractions of bainite. It is, therefore, desirable to produce hardened rails that are as free of bainite on the running surface as possible. It is for this reason that the present inventors turned their attention to steel chemistries other than standard carbon rail steel chemistries.

The method of the present invention is adapted to produce hardened railway rails having a low alloy steel chemistry, by means of an in-line process, close coupled to the Hot Rolling Mill. A preferred embodiment comprises the following steps:

Step 1

Selecting a low alloy steel chemistry that has isothermal transformation characteristics such that the steel transforms to pearlite more rapidly than to bainite. Such a steel chemistry can be achieved by using a combination of chemical elements selected from within the ranges given in Table I.

TABLE I

| Element | Amount of Weight Percent |
|---|---|
| Carbon | 0.60 to 0.82 |
| Manganese | 0.60 to 1.20 |
| Silicon | up to 1.20 |
| Chromium | 0.20 to 1.00 |
| Vanadium | up to 0.20 |
| Niobium | up to 0.05 |
| Titanium | up to 0.03 |
| Molybdenum | up to 0.30 |
| Balance | Iron and Incidental Impurities |

Step 2

Heating ingots or blooms of the steel described in Step 1 to a temperature of about 1900° F. or higher.

Step 3

Rolling said ingots or blooms into a railway rail section using any of the various types of rolling mills for rolling shaped steel products. The rolling time-temperature reduction scheduled may be tailored to achieve reduction in the steel cross section area at temperatures below the austenite recrystallization temperature of the selected steel chemistry in order to enhance the desirable isothermal transformation characteristics described in Step 1. Reduction below the recrystallization temperature may or may not be possible depending on the mill used and its process control system.

Step 4

Forced cooling the rail head of the hot rolled rail from a temperature above the austenite-to-ferrite equilibrium temperature for the selected steel chemistry at a rate such that the start of the austenite-to-ferrite transition is not reached prior to the termination of forced cooling, said cooling being accomplished in such a fashion that the surface of the steel is maintained above the martensite transition temperature for the selected steel chemistry. A cooling rate of about 3° F./second or higher is required for the steel described in Table I.

Step 5

Terminating the forced cooling when the rail reaches a temperature within a preselected range of temperatures, said preselected range being such that when said rail is held isothermally within said range that said rail steel transforms to fine pearlite. The preferred range is approximately 1000° F. to 1200° F., although advantage can be attained with a range from about 850° F. to about 1200° F. From experience, it has been found that the most preferred range is about 1000° to 1100° F.

Step 6

Holding said rail under isothermal conditions or near isothermal conditions within said selected temperature range until the steel has finished its transformation to pearlite. Depending on the isothermal hold temperature used, the rail steel may complete said transformation in as little as 50 seconds (isothermal transformation temperature =1112° F. (600° C.)) or as long as 6000 seconds (isothermal transformation temperature=887° F. (475° C.)). Therefore, the hold time required will vary significantly with the isothermal hold temperature employed.

Figure 2:
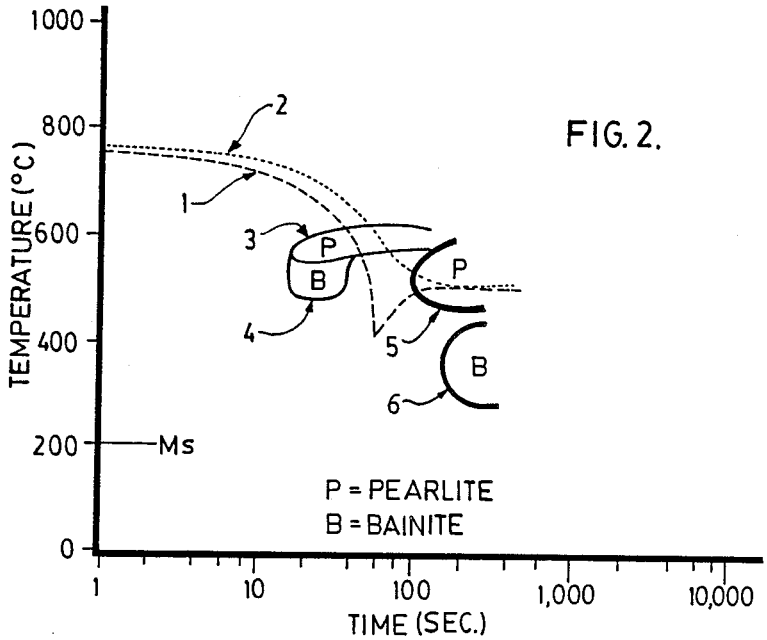
FIG. 2 shows FIG. 1 redrawn to include a continuous cooling transformation diagram for an alloy rail steel chemistry with a composition by weight of 0.79% carbon, 1.00% manganese, 0.54% silicon, and 0.81% chromium, the balance being iron and incidental impurities.
Figure 3:
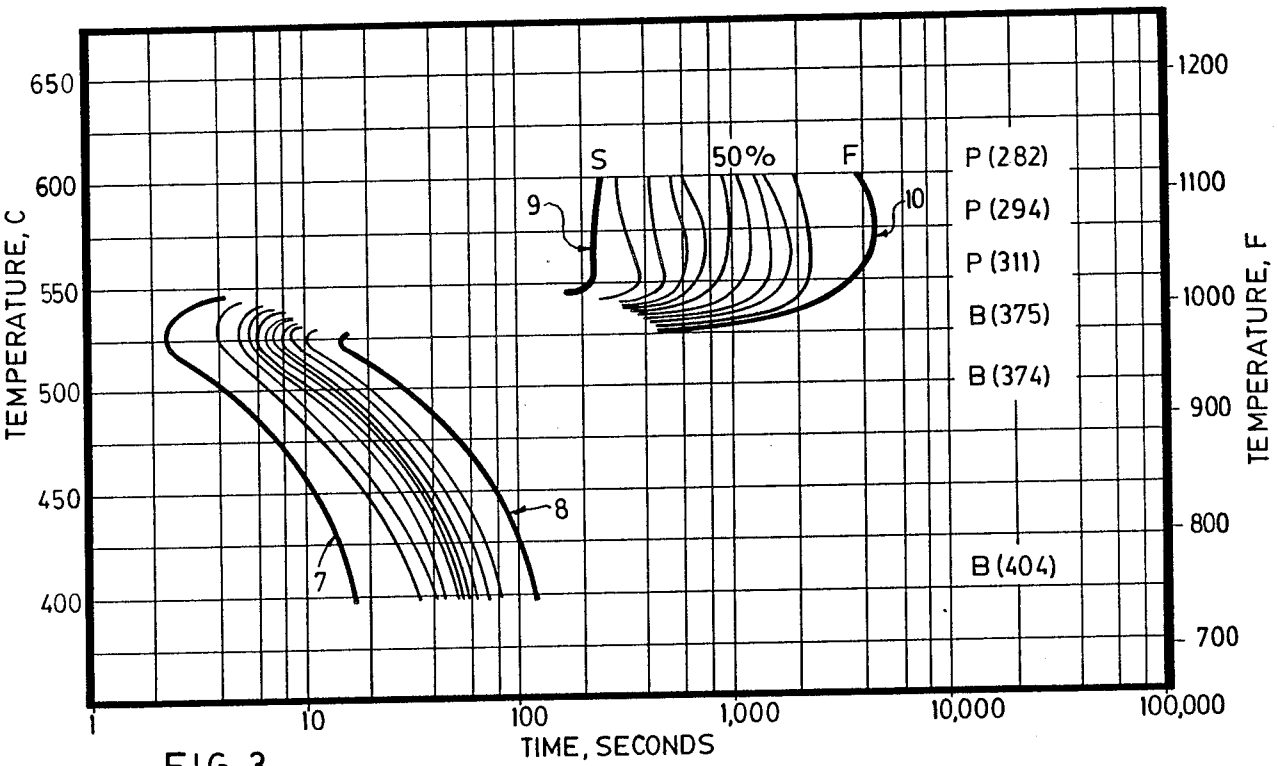
FIG. 3 shows the isothermal transformation diagram determined for the same carbon rail steel chemistry described in FIG. 1, above.

FIG. 2 is a reproduction of FIG. 1, with the addition of a partial continuous cooling transformation diagram for a low alloy chromium-silicon rail steel chemistry of the present invention. In this figure, P denotes the areas delineated by curves 3 and 5, in which the steels are transformed from austenite to pearlite, and B denotes the areas delineated by curves 4 and 6, in which the steels are transformed from austenite to bainite. From FIG. 2, it can be seen that the use of the method of the present invention makes it easier to avoid bainite on the rail surface, since curve 1 is further removed from the bainite zone of curve 6 than it is from the bainite zone of curve 4. When cooling curves 1 and 2 in FIG. 3 are considered in conjunction with the continuous cooling transformation diagram for the chromium-silicon low alloy rail steel (curves 5 and 6), it is evident that in the case of the subject method, no metallurgical phase change occurs prior to the termination of forced cooling in the case of said low alloy steel. Additionally, it is apparent that the rail head remains at a near constant temperature during the metallurgical transformation from austenite to pearlite. It is therefore more correct to use isothermal transformation diagrams to describe the metallurgical reactions taking place.

FIGS. 3, 4, 5 and 6 are isothermal transformation diagrams which illustrate the metallurgical transformation reactions of the method of the present invention. These diagrams were determined experimentally using dilatometric techniques. In FIGS. 3 - 6, P denotes the pearlitic microstructure achieved at the corresponding isothermal transformation temperature, and B denotes the bainitic microstructure achieved at the corresponding isothermal transformation temperature. The numbers in parenthesis denote the measured hardnesses of the rail steel with the corresponding microstructures transformed at the indicated isothermal transformation temperatures. The hardness scale used in these diagrams is the Vickers Hardness Numbers (VHN), because the specimens used in determining isothermal transition curves are too small to use the Brinell Hardness Number (BHN) scale.

Figure 4:
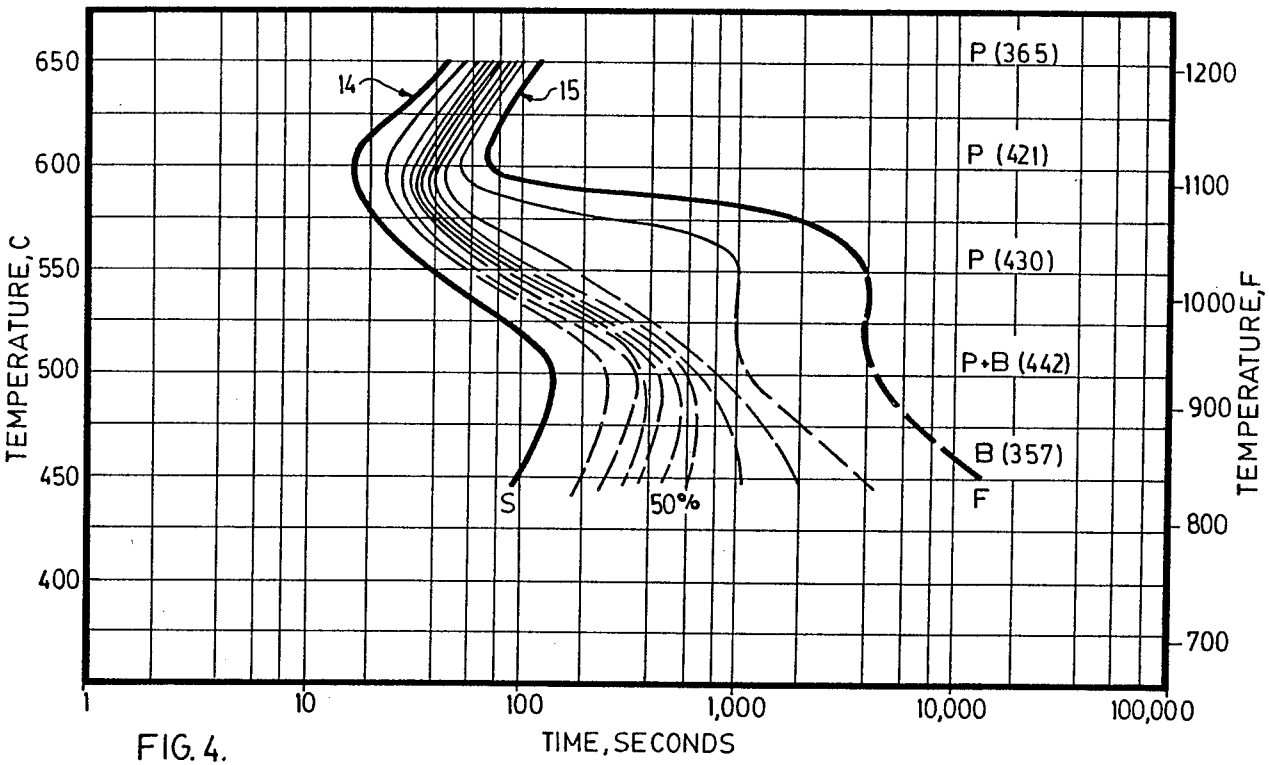
FIG. 4 shows the isothermal transformation diagram determined for the same alloy steel chemistry as described in FIG. 2, above.
Figure 5:
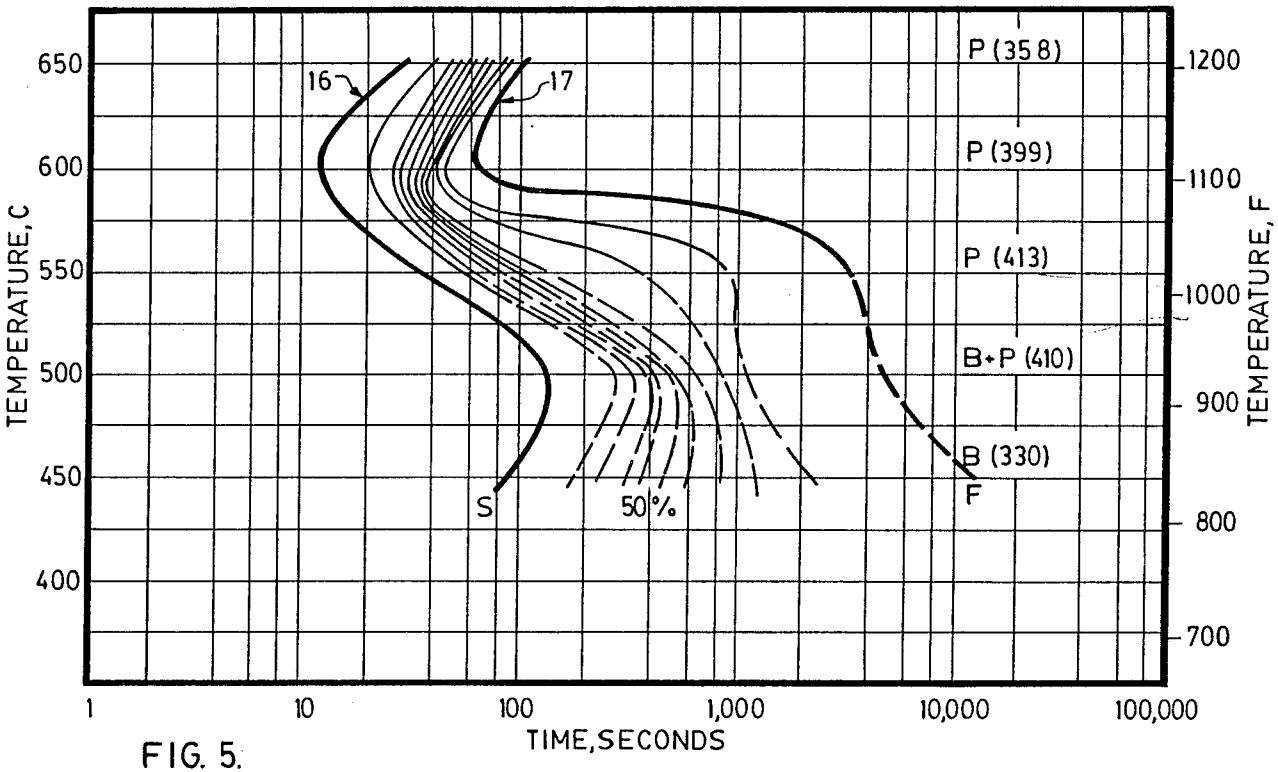
FIG. 5 shows the isothermal transformation diagram for an alloy rail steel chemistry with a composition by weight of 0.75% carbon, 0.96% manganese, 0.75% silicon, 0.64% chromium, the balance being iron and incidental impurities.
Figure 6:
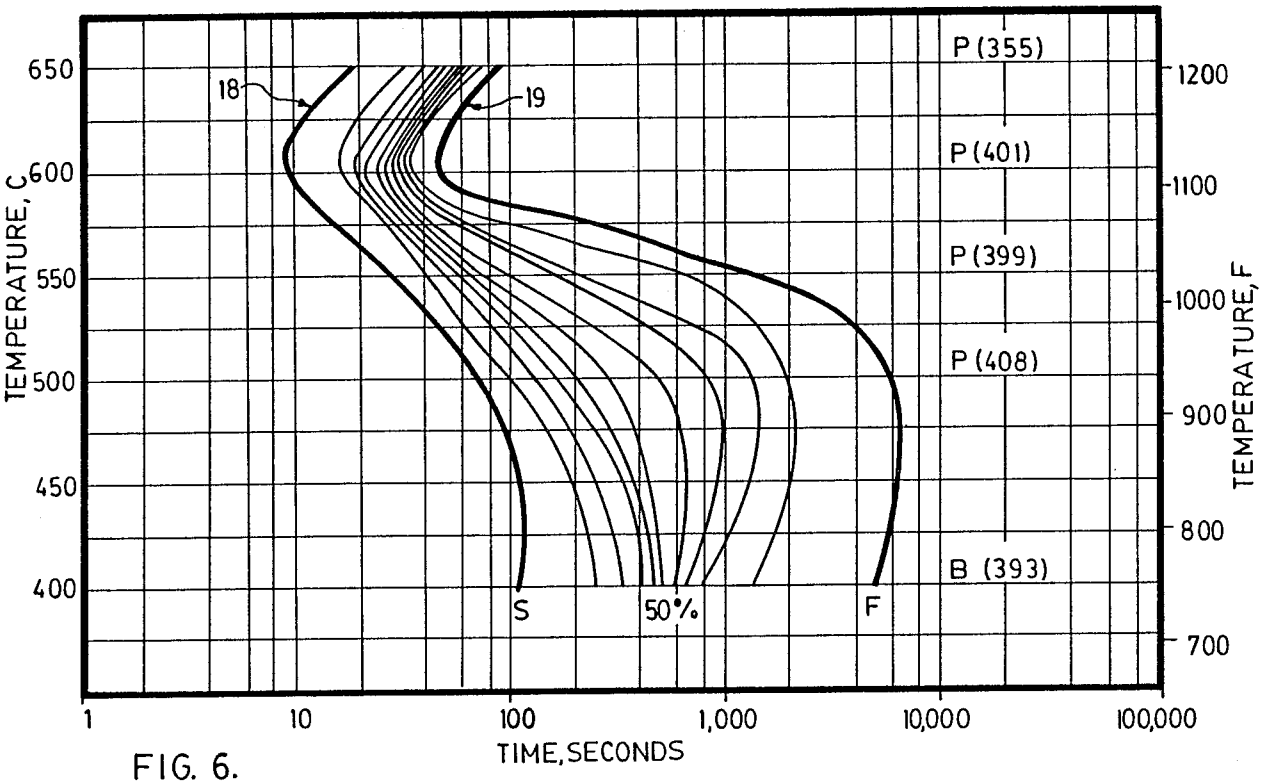
FIG. 6 shows the isothermal transformation diagram for an alloy rail steel chemistry with a composition by weight of 0.80% carbon, 0.75% manganese, 0.68% silicon, 0.51% chromium, 0.006% columbium, the balance being iron and incidental impurities.

An examination of FIGS. 4, 5 and 6 in comparison with FIG. 3 reveals that the use of the method of the present invention has a surprising and dramatic influence on the isothermal transformation characteristics of rail steel. As shown in FIG. 3, an isothermal transformation diagram for plain carbon steel, the austenite-to-pearlite time-temperature transformation, as bounded by curves 9 and 10, occurs at a time much later than for the austenite-to-bainite reaction, bounded by curves 7 and 8. This is believed to be because the bainite reaction requires carbon diffusion over shorter distances than the pearlite reaction.

In FIGS. 4–6, the isothermal transformation diagrams for the low alloy steels of the present invention, it is seen that the austenite to pearlite transformation has been shifted to occur at earlier times than for the standard carbon steel, and that the austenite to bainite transformation has been shifted to occur at later times. That is, in the case of these low alloy steels, the pearlite reaction precedes time-wise the bainite reaction, during isothermal transformation. This reversal of the relative times for the pearlite and bainite reactions of the alloy steel relative to the unalloyed steel appears to contradict conventional wisdom on the subject. See for example, W. J. Park and F. D. Fletcher, "Effects Of Manganese, Chromium And Molybdenum On The Isothermal Transformation of Austenite In Eutectoid Steels", J. Heat Treating, Vol. 4, 1986, pp 247–252. Such reversal has not been reported in prior work known to the present inventors.

This reversal of the relative times for the pearlite and bainite reactions during isothermal transformation for the alloyed steels relative to the standard carbon rail steels is believed by the inventors to be due to the differences in austenite grain size and the presence of the second phase particles at the beginning of the cooling cycle. The standard carbon steel has a relatively large prior austenitic grain size, while the prior austenite grain size for the steel represented in FIG. 4 (Cr-Si) is much smaller. The prior austenite grain size of the steel represented in FIG. 5 (Si-Cr) is smaller yet, and the columbium alloy steel represented in FIG. 6 had the smallest prior austenite grain size. The relationship between prior austenite grain size to the time taken to start the isothermal pearlite transformation is illustrated in Table II. It is known that niobium forms fine second phase particles in austenite by combining with carbon and residual nitrogen impurities in the steel.

TABLE II

| Prior Austenite Grain Size Ranking | Steel Type | Time to Start Isothermal Pearlite Reaction (Seconds) |
|---|---|---|
| Largest | Standard Carbon | 120 |
| Finer | Cr—Si (FIG. 4) | 11.5 |
| Finer | Si—Cr (FIG. 5) | 10.5 |
| Finest | Si—Cr—Nb (FIG. 6) | 9 |

In any time-temperature controlled phase change in solid materials, the overall transformation rate is a function of the nucleation rate and growth rate. Growth rate decreases continuously with decreasing temperature. Nucleation rate begins at zero at the equilibrium temperature above which the high temperature phase is stable and increases with decreasing temperature and attendant increasing thermodynamic driving force until it reaches a maximum rate after which it decreases again with further decreases in temperature as atomic mobility becomes too low despite the high thermodynamic driving force. In the case of steel, there are two families of nucleation and growth controlled phase transformations which take place when the steel is cooled from a temperature above the austenite to ferrite equilibrium temperature. At temperatures just below said equilibrium temperature, the ferrite and pearlite reactions occur. These reactions are considered a single family because they take place more or less simultaneously. In low carbon steels, the ferrite reaction begins earlier than the pearlite reaction and they are essentially completed at the same time. In eutectoid carbon steel (i.e. steel with carbon contents close to 0.82%, depending on the amounts of other alloying elements present), the ferrite and pearlite reactions begin and end at essentially the same time and temperatures. Rail steels used in North America are near eutectoid steels with carbon content at or just below 0.82%. In these steels, the separation of the beginning of the ferrite reaction from the beginning of the pearlite reaction is difficult to measure. Consequently, the ferrite-pearlite reaction in rail steel is commonly referred to simply as the pearlite reaction. At temperatures too low for the nucleation and growth of ferrite and pearlite, the bainite reactions occur. Again, the bainite reactions are a family of transformations that are very difficult to separate in relation to time and temperature. As a consequence, the reaction products are commonly referred to collectively as bainite. In steel, the rate of nucleation in austenite below the austenite to ferrite equilibrium temperature increases with decreasing grain size. Increasing the amount of grain distortion by working the steel below the austenite recrystallization temperature and the introduction of appropriately sized second phase particles will also increase the rate of nucleation in said austenite. It is known that the presence of alloying elements such as manganese, chromium and molybdenum tend to make nucleation and growth controlled phase changes in steel more sluggish with increasing alloy content.

From the evidence given in FIGS. 3–6 and Table II, it is believed that the combined effects of austenite grain refining, the presence of second phase precipitates in the austenite and the presence of the alloying elements manganese, silicon and chrome, have different net effects on the pearlite reaction as compared to the bainite reaction. In the cases discussed above, the net effect is to accelerate the pearlite reaction and to retard the bainite reaction during isothermal phase transformations. This has direct and significant benefits in the production of hardened railway rails which are heat treated in-line with the hot rolling mill because the time separation of the reactions make the avoidance of bainite easier to achieve when an isothermal temperature holding practice is used.

Further evidence supporting the validity of the pearlite-bainite reaction time reversal was obtained when low alloy rail steels containing silicon and chromium and vanadium or titanium were made by the method of the present invention. Vanadium and titanium in combination with carbon and residual nitrogen in steel form second phase particles in austenite that act as grain refiners and nucleation sites. In both cases, reactions consistent with the expectations predicted by the contents of FIGS. 4–6 were achieved.

Examination of FIGS. 3–6 reveals an additional advantage for the present invention in that the hardness values achieved in the isothermally transformed pearlite in the represented low alloy steels are both higher and less sensitive to the transformation temperatures used than the pearlite formed in the standard carbon steel. Similar relationships were observed when chromium-silicon alloy rail steel containing vanadium or titanium were processed. The advantage is that the process control system has more latitude in achieving the cooling stop temperature when the referenced alloy steels were utilized. Further advantages are also realized in that the depth of hardness is superior with the alloy steels.

The temperature range in which isothermal transformation in the alloy steels represented in FIGS. 4, 5, and 6 lead to hardened pearlite microstructures varies from a low of about 850° F. (450° C.) for the steel represented in FIG. 6 right up to the highest temperature investigated, 1200° F. (650° C.).

Carbon is an essential alloying element in rail steel, generally being specified by standards associations such as AREA to be within the limits of 0.60 to 0.82% by weight. The higher the carbon content, the harder and more wear resistant the rail. However, at levels significantly over 0.82%, carbon can form hypoeutectoid iron carbide compounds on prior austenite grain boundaries which lead to brittleness of the metal. The most preferred carbon range is 0.70 to 0.82 percent.

Silicon is a desirable rail steel alloy element due to its effects as a solid solution hardener for the ferrite between the iron carbide in lamallae pearlite. At levels over 1.20%, silicon may cause embrittlement in flash butt welds used to join rails. Also, silicon is commonly used as a deoxidizing agent in steel at levels over 0.20%. However, silicon present as large silica inclusions in the rail steel has been shown to be detrimental to the fatigue characteristics of railroad rails. For this reason, some manufacturers omit silicon entirely in preference to other deoxidation means. The preferred silicon content for the present invention is from 0.20 to 0.50%.

Manganese is a desirable alloy element both because of its influence on the hot ductility of steel during rolling and because of its influence on the rate of pearlite transformation during continuous or isothermal cooling. Manganese below about 0.60% would not have the desired benefits to the isothermal time-temperature reactions used in the present invention. Over about 1.20% manganese causes embrittlement in flash butt welds. The preferred manganese range is 0.70 to 1.10%.

Chromium is a desirable alloying element because of its strong influence on the bainite reaction in the isothermal time-temperature reactions used in the present invention. Additionally, chromium helps maintain weld zone hardness in flash butt welds. Chromium levels of 0.20% to 1.50% can be usefully employed in the present invention. Chromium is limited to 1.50% maximum because at higher levels, extra precautions must be exercised to prevent excessive weld zone hardness and embrittlement in flash butt welds. In the preferred embodiment of the invention, a chromium content within the range of 0.25 to 1.00% is selected, because the weld zone hardness achieved from naturally cooled flash butt welds is balanced with the hardness of the parent metal in the rail head. In another preferred embodiment of the invention, the chromium content is within the range of 0.25 to 0.55%. As the chromium content is increased above about 1.00%, the rail becomes increasingly difficult to weld. Thus, embodiments of the present invention having chromium contents in the range of about 1.00 to 1.50% do not possess all of the advantages of the preferred embodiments.

Molybdenum has a very strong influence on the time-temperature transformation reactions in steel. However, its usefulness in the present invention is limited because molybdenum causes problems in flash butt welds and because sufficient control of the isothermal time-temperature reactions for the present invention can be achieved with less expensive alloy elements. Molybdenum is, therefore, limited to 0.30% maximum and in the most preferred embodiment to 0.10% maximum.

Niobium (Columbium) is a useful alloy element in the present invention because it forms second phase compounds with the carbon and residual nitrogen in the steel that act as grain refiners in austenite and provide nucleation sites for the isothermally transforming ferrite. However, at levels over 0.05%, columbium is believed to cause embrittlement in high carbon rail steel.

Vanadium is useful both as a grain refiner and as a precipitation hardener. Additions of vanadium much in excess of about 0.20% are believed to cause embrittlement and are, therefore, avoided. In the most preferred embodiment of the present invention, vanadium is present up to a level of about 0.10%.

Titanium present in the steel in the form of titanium nitride is an effective austenite grain refiner even at levels as low as 0.005 to 0.015. However, at levels over 0.03%, or when residual nitrogen is at relatively high levels in the steel, large titanium nitrides in the form of cuboids are formed. These cuboids are detrimental to the rail steel toughness.

In the most preferred embodiment of the invention, columbium, vanadium and titanium can be used singularly or in combination, in addition to chromium, to achieve the desired effects. However, useful benefit can be achieved when these additional alloy elements are excluded.

The balance of the steel used in this invention is iron and incidental impurities. Said incidental impurities include, but are not restricted to, sulphur, phosphorus, small amounts of elements such as aluminium present as the product of steel deoxidation practice, copper and nickel.

Sulphur and phosphorus present in large amounts are injurious to the rail product and are, therefore, limited by specifications to levels typically affect less than 0.035% each. It is known that sulphur may negatively affect wear rates in rails under some service conditions. Sulphur is, therefore, sometimes restricted to much lower levels.

Aluminum present as a product of steel deoxidation is generally restricted to levels below 0.02% because large alumina inclusions in rail steel are known to cause defects to occur in rails during use.

Copper and nickel may be present in rail steel in relatively large amounts as incidental impurities, or as "residual elements" as they are called in the trade, especially if the steel is made from remelted scrap. Experimentation has demonstrated that copper and nickel do not significantly affect the present invention when present singularly or in combination at levels up to 0.50% each.

There are a number of ways of achieving the last step of the subject method, i.e. holding the rail under isothermal conditions during the austenite to pearlite transformation. A preferred way of doing so is to subject the rail head to intermittent forced cooling by the method taught in U.S. Pat. No. 4,486,248. If this method is employed, heat soak back from the web to the rail head counteracts the natural cooling of the head, when forced cooling is terminated, thereby achieving the desired isothermal or near isothermal conditions for the austenite-to-pearlite transformation in the rail head, at least in the case of the higher cooling stop temperatures. However, if a cooling stop temperature significantly below 1000° F. is employed, a means of retarding the natural cooling rate may be necessary to ensure that the rail steel has completed its transformation to pearlite prior to reaching a temperature at which bainite may form. One means of retarding the rail cooling is to place the rail into a slow cooling box of the type commonly used in the rail production industry for the diffusion of residual hydrogen out of the steel.

If an intermittent cooling method such as that disclosed in U.S. Pat. No. 4,486,248 is used, it has been found that no compensation is required for the release of latent energy due to the austenite-to-pearlite transformation. Relative to the continuous cooling transformation of standard carbon rail steel, the isothermal transformation of steels described in Table I results in the latent energy being released over a longer period of time. The overall energy balance in the rail head is such that heat conducted up from the lower head and upper web portions of the rail plus the heat of transformation is approximately balanced by the loss of energy due to radiant and conductive heat loss to the atmosphere. Thus, the release of said latent energy does not result in a significant temperature increase in the rail head when said method is employed.

However, if alternative cooling methods were to be employed (e.g. those not utilizing intermittent forced cooling), it is forseen that it may be necessary or desirable to apply a heat removal medium to the rail head after the start of the austenite-to-pearlite transformation, in order to compensate for the release of latent energy. The heat removal medium could take the form of water spray or other coolant used to effect the forced cooling, applied to the rail head at a relatively low volume or intensity.

The introduction of a hold time after hot rolling and prior to the beginning of forced cooling provides advantages to the process. Allowing the rail to cool in air until it reaches a preselected forced cooling start temperature provides a fixed start temperature reference from which the forced cooling can be initiated. Said fixed start temperature allows the construction of a less complex process control system than would be required otherwise. The use of a forced cooling start temperature preselected in a temperature range just above the austenite-to-ferrite transition temperature minimizes the amount of forced cooling required and thus allows the use of minimum amount of process equipment.

The inventors have demonstrated that cooling start temperatures as much as 50° F. below the austenite-to-ferrite equilibrium temperature can be used if the steel is still austenitic. However, the use of a cooling start temperature much below said equilibrium temperatures would be expected to introduce an element of instability into the process and is, therefore, not considered a preferred embodiment of the invention.

The austenite-to-ferrite equilibrium temperature for the steels described in Table I will vary with the exact chemical composition. The amount of reduction during rolling below the austenite crystallization temperature will also influence the transition temperature. Typically, said equilibrium temperature is in the range of 1400° F. to 1440° F. for the steel described in Table I. Cooling start temperatures selected in the temperature range of 1350° F. to 1600° F. as measured on the surface of the rail head have been employed experimentally. The preferred cooling start temperature is in the range between said equilibrium temperature and about 100° F. above it. For the aforesaid steels, the preferred cooling temperature is in the range of about 1400° F. to 1550° F.

EXAMPLES

The present invention will be further illustrated by way of the following examples. In each example, the steel was made in the 105 ton heats in a basic oxygen steel plant and cast by the continuous casting method into 10.5 inch by 12.5 inch by 19 foot blooms. These blooms were reheated to approximately 2100° F. and rolled into 136 lb/yd AREA rail section in a caliper type rolling mill. Following rolling, the rails were force cooled by the force cooling method of the present invention.

FIGS. 7–11 show the cross-sectional hardness maps measured for Examples 1–5, respectively. The hardness values shown are Brinell hardness numbers.

Example 1

The rail steel chemistry employed is shown in Table III.

TABLE III

| Element | Amount Weight Percent |
|---|---|
| Carbon | 0.77 |
| Manganese | 0.90 |
| Silicon | 0.45 |
| Chromium | 0.78 |
| Balance | Iron & Incidental Impurities |
| Cooling start temperature | 1450° F. |
| Cooling stop temperature | 1000° F. |

Figure 7:
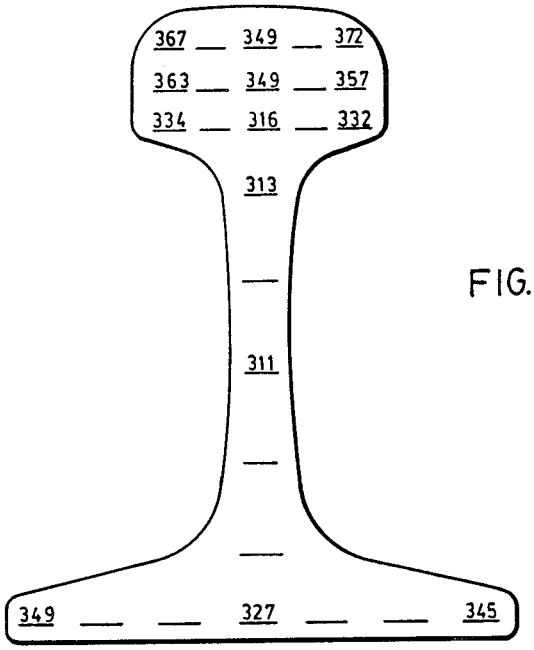
FIG. 7 shows the cross sectional hardness map measured for Example #1.

The hardness achieved in this example is shown in FIG. 7.

Example 2

The steel chemistry employed is shown in Table IV.

TABLE IV

| Element | Amount Weight Percent |
|---|---|
| Carbon | 0.77 |
| Manganese | 0.88 |
| Silicon | 0.44 |
| Chromium | 0.84 |
| Columbium | 0.018 |
| Balance | Iron & Incidental Impurities |
| Cooling start temperature | 1475° F. |
| Cooling stop temperature | 1000° F. |

Figure 8:
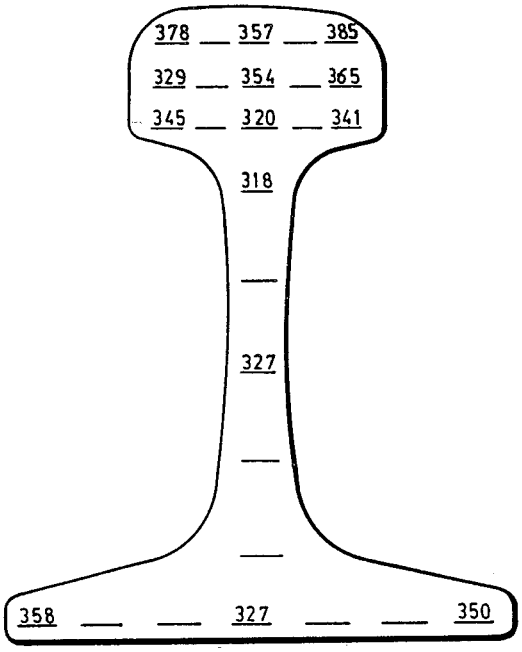
FIG. 8 shows the cross sectional hardness map measured for Example #2.

The hardness achieved in this example is shown in FIG. 8.

Example 3

The steel chemistry employed is shown in Table V.

TABLE V

| Element | Amount Weight Percent |
|---|---|
| Carbon | 0.75 |
| Manganese | 0.97 |
| Silicon | 0.41 |
| Chromium | 0.80 |
| Titanium | 0.016 |
| Balance | Iron & Incidental Impurities |
| Cooling start temperature | 1475° F. |
| Cooling stop temperature | 1050° F. |

Figure 9:
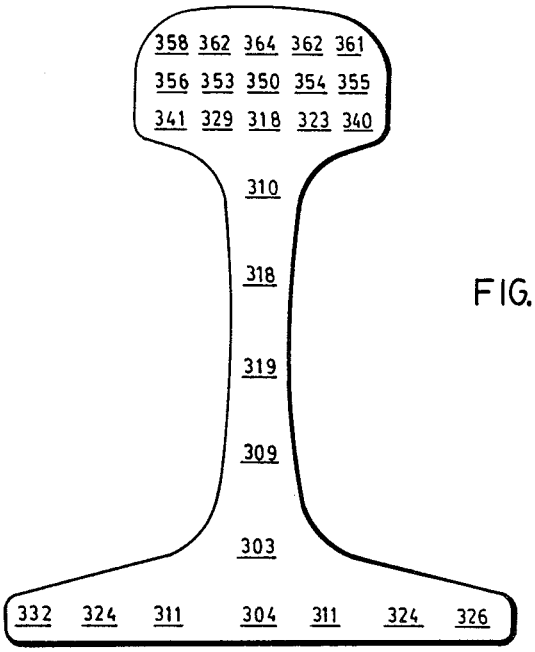
FIG. 9 shows the cross sectional hardness map measured for Example #3.

The hardness achieved in this example is shown in FIG. 9.

Example 4

The chemistry for this example is shown in Table VI.

TABLE VI

| Element | Amount Weight Percent |
|---|---|
| Carbon | 0.82 |
| Manganese | 1.02 |
| Silicon | 0.50 |
| Chromium | 0.34 |
| Titanium | 0.028 |
| Balance | Iron & Incidental Impurities |
| Cooling start temperature | 1475° F. |
| Cooling stop temperature | 1050° F. |

Figure 10:
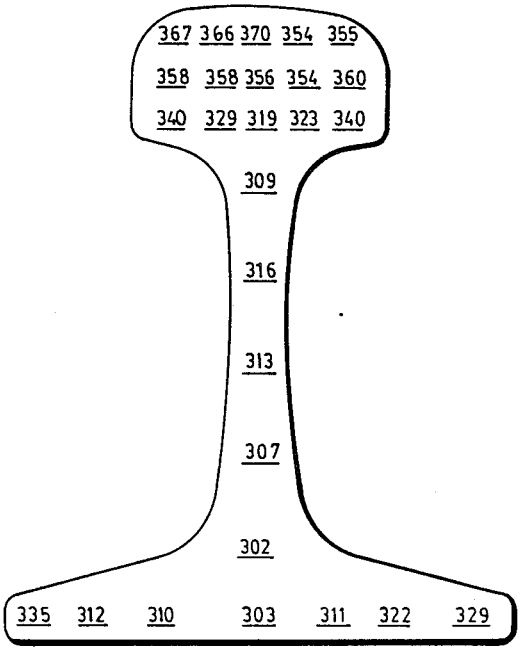
FIG. 10 shows the cross sectional hardness map measured for Example #4.

The hardness achieved in this example is shown in FIG. 10.

Example 5

The chemistry employed in this example are shown in Table VII.

TABLE VII

| Element | Amount Weight Percent |
|---|---|
| Carbon | 0.80 |
| Manganese | 1.01 |
| Silicon | 0.46 |
| Chromium | 0.34 |
| Vanadiumm | 0.068 |
| Balance | Iron & Incidental Impurities |
| Cooling start temperature | 1475° F. |
| Cooling stop temperature | 1050° F. |

Figure 11:
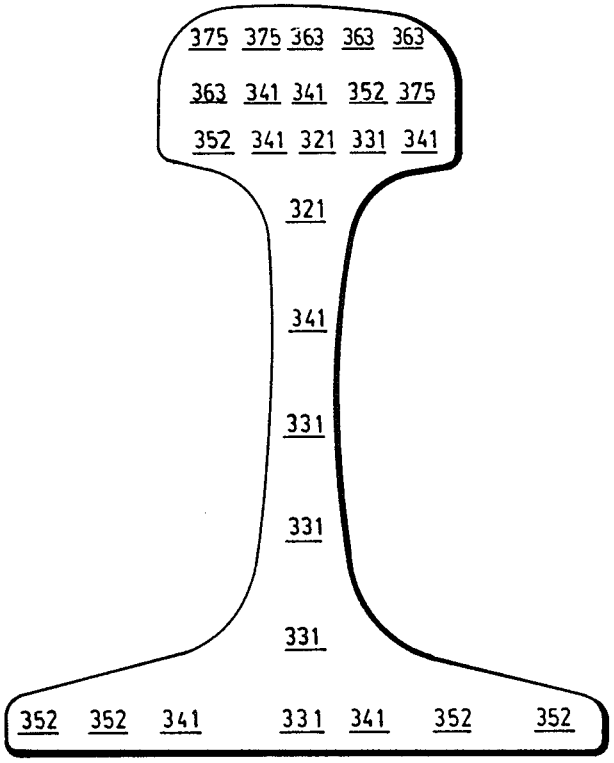
FIG. 11 shows the cross sectional hardness map measured for Example #5.

The hardness achieved in this example is shown in FIG. 11.

In each of the foregoing examples, determination of the laminar iron carbide spacing in the pearlite by examination of specimen material at 15,000 magnification in a scanning electron microscope revealed that the interlaminar spacing of said carbides typically averaged less than 0.10 microns in the hardened portion of rail. The range of average iron carbide spacing was 0.065 to 0.10 microns. This compares to an expected average linear carbide spacing of 0.15 to 0.2 microns for a naturally cooled rail steel.

In the foregoing discussions and examples it is understood that the temperatures referred to are in reference to the temperature of the rail head, this being the portion of the rail in which enhanced hardness is desired. The cooling stop temperature herein referenced is the temperature of the rail head below the surface of the steel at a depth of about 0.375 inches (10 mm), the surface temperature being typically below the core temperature of the rail head. As mentioned previously, the surface temperature must be maintained above the martensite start temperature. The cooling stop temperature may be measured by taking a surface temperature measurement approximately 60 seconds after the termination of forced cooling since the core and the surface temperature have been found to be approximately equalized by this time.

It should also be understood that the beginning of the austenite-to-ferrite transition in an industrial process is difficult to identify time wise. In the preferred embodiment of the invention, forced cooling is terminated time wise prior to the beginning of the austenite-to-pearlite transformation. However, for the reason given above, it is recognized that a volume fraction of austenite may actually begin to transform prior to the termination of forced cooling. Therefore, the scope of the invention includes all cases wherein said forced cooling is terminated prior to the time at which a substantial volume fraction of the austenite begins to transform to ferrite.

Since changes could be made in the above disclosed method and apparently different embodiments of the invention could be made without departing from the scope thereof, it is intended that all matter contained in the above description, shown in the accompanying drawings and contained in the examples shall be interpreted as being illustrative only and not limiting. One such change would be to subject the entire ail cross section to the described heat treatment rather than just the head portion thereof.

Accordingly, while the present invention has been described and illustrated with respect to the preferred embodiments, it will be appreciated that variations of the preferred embodiments may be made without departing from the scope of the invention, which is defined in the appended claims.

The embodiments of the invention in which an exclusive property or privilege is claimed are defined as follows:

1. A method for manufacturing and treating a railroad rail, comprising the steps of:

(a) forming hot a railroad rail from an alloy steel of preselected chemical composition;

(b) force cooling at least the rail head of the rail from a preselected cooling start temperature above about the austenite-to-ferrite transformation temperature such that the surface of the rail head is maintained above the martensite start temperature;

(c) terminating the forced cooling when the temperature of the rail head reaches a preselected cooling stop temperature, and before a substantial volume fraction of the austenite in the rail head has transformed to pearlite; and (d) holding the rail head under substantially isothermal conditions until the austenite-to-pearlite transformation is complete;

(e) wherein the chemical composition of the alloy steel is selected such that the austenite-to-pearlite reaction occurs earlier in time than the austenite-to-bainite reaction under said substantially isothermal conditions.

2. The method as defined in claim 1, wherein the forced cooling is terminated prior in time to the beginning of the austenite-to-pearlite transformation.

3. The method defined in claim 2, wherein the preselected alloy steel chemical composition comprises about 0.20% to 1.00% chromium.

4. The method as defined in claim 3, wherein the preselected cooling stop temperature is in the range from about 850° F. to about 1200° F.

5. The method as defined in claim 4, wherein the cooling start temperature is above about 1350° F.

6. The method as defined in claim 5, wherein the preselected stop temperature is in the range from about 1000° F. to about 1100° F.

7. The method as defined in claim 1, wherein the step of holding the rail head under substantially isothermal conditions includes applying a heat removal medium to the rail head in order to compensate for the rise in temperature of the rail head due to the release of latent heat during the austenite-to-pearlite transformation.

8. A method for manufacturing and treating a railroad rail, comprising the steps of:

(a) forming hot a rail from an alloy steel whose chemical composition is within limits by weight of about 0.70 to 0.82% carbon, about 0.70 to 1.10% manganese, about 0.20 to 1.50% chromium, up to about 0.20% vanadium, up to about 0.05% columbium, up to 0.03% titanium, up to about 0.30% molybdenum, the balance being iron and incidental impurities;

(b) force cooling at least the rail head of the rail from a cooling start temperature above about 1350° F., in such a manner that the surface of the rail is maintained at temperatures above the martensite start temperature for rail steel;

(c) terminating the forced cooling when the temperature of the rail head reaches a preselected cooling stop temperature, prior in time to the beginning of the austenite-to-pearlite transformation; and (d) holding the rail head under substantially isothermal conditions until the austenite to pearlite transformation is complete, whereby the austenite-to-pearlite reaction occurs prior in time to the austenite-to-bainite reaction.

9. The method of claim 8, wherein the alloy steel contains from about 0.20 to 1.00% chromium.

10. The method of claim 9, wherein the alloy steel comprises up to about 0.10% vanadium and up to about 0.10% molybdenum.

11. The method of claim 8, wherein the preselected stop temperature is in the range from about 850° F. to about 1200° F.

12. The method of claim 9, wherein the stop temperature is in the range from about 1000° F. to 1200° F.

13. The method of claim 8, wherein the preselected stop temperature is in the range from about 1000° F. to 1100° F.

14. The method of claim 8, wherein the cooling start temperature is above about 1400° F.

15. The method of claim 8, wherein only the rail head is subjected to said forced cooling.

16. The method of claim 1, wherein only the rail head is subjected to said forced cooling.

17. The method of claim 1, wherein the rail is subjected to said forced cooling following formation of the rail by a hot forming process without intervening reheating.

18. The method of claim 1, wherein the forced cooling begins at a cooling start temperature above about 50° F. below the austenite-to-ferrite equilibrium temperature while the rail is still in a fully austenitic condition.

19. The method of claim 1, wherein the rail is held under substantially isothermal conditions so as to complete the austenite-to-pearlite transformation, by placing the rail in an enclosure.

20. The method of claim 19, wherein the enclosure is a slow cooling box.

21. The method of claim 1, wherein the cooling start temperature is preselected to be in a range from about the austenite to ferrite equilibrium temperature to about 100° F. above said equilibrium temperature.

22. The method of claim 1, wherein the time-temperature-reduction schedule during the hot forming of the rail is such that there is a reduction in the steel cross-sectional area at temperatures below the austenitic recrystallization temperature of said steel.

* * * * *

UNITED STATES PATENT AND TRADEMARK OFFICE

CERTIFICATE OF CORRECTION

PATENT NO. : 4,895,605

DATED : January 23, 1990

INVENTOR(S) : Robert J. Ackert, Murray A. Nott

It is certified that error appears in the above-identified patent and that said Letters Patent is hereby corrected as shown below:

In column 3, line 36, please delete "47." and substitute therefore --4.--

In column 12, line 64, please delete "ail" and substitute therefore --rail--.

In column 14, lines 32-33, please delete "only the rail head is subjected to said forced cooling." and substitute therefore --the alloy steel contains from about 0.25 to 0.55% percent chromium.---

Signed and Sealed this

Twenty-eighth Day of May, 1991

*Attest:*

*Attesting Officer*

HARRY F. MANBECK, JR.

*Commissioner of Patents and Trademarks*